US009488956B2

(12) United States Patent
Taira et al.

(10) Patent No.: US 9,488,956 B2
(45) Date of Patent: Nov. 8, 2016

(54) IMAGE FORMING APPARATUS HAVING DRAWER

(71) Applicant: Brother Kogyo Kabushiki Kaisha, Nagoya-shi, Aichi-ken (JP)

(72) Inventors: Kazuya Taira, Nagoya (JP); Atsushi Hayakawa, Okazaki (JP); Takuya Yamaguchi, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/006,637

(22) Filed: Jan. 26, 2016

(65) Prior Publication Data

US 2016/0216683 A1 Jul. 28, 2016

(30) Foreign Application Priority Data

Jan. 26, 2015 (JP) ..... 2015-012580

(51) Int. Cl.
*G03G 21/16* (2006.01)
*G03G 21/18* (2006.01)

(52) U.S. Cl.
CPC ..... *G03G 21/1604* (2013.01); *G03G 21/1839* (2013.01); *G03G 21/1853* (2013.01); *G03G 2221/1678* (2013.01); *G03G 2221/1869* (2013.01)

(58) Field of Classification Search
CPC ..... G03G 21/1604; G03G 21/1619; G03G 21/1839; G03G 21/1842; G03G 21/1853; G03G 2221/1678; G03G 2221/1684; G03G 2221/1869
USPC ..... 399/110, 112
See application file for complete search history.

(56) References Cited

U.S. PATENT DOCUMENTS

| | | | | |
|---|---|---|---|---|
| 5,740,498 | A * | 4/1998 | Tsuchiya | G03G 15/6558 399/123 |
| 7,586,508 | B2 | 9/2009 | Tamaru et al. | |
| 7,647,003 | B2 | 1/2010 | Itabashi | |
| 8,380,103 | B2 | 2/2013 | Souda | |
| 8,417,177 | B2 | 4/2013 | Ito et al. | |
| 2003/0053819 | A1 | 3/2003 | Nomura et al. | |
| 2005/0105953 | A1 | 5/2005 | Katayama et al. | |
| 2005/0220479 | A1 | 10/2005 | Ito et al. | |

(Continued)

FOREIGN PATENT DOCUMENTS

| | | | |
|---|---|---|---|
| EP | 1610188 | A2 | 12/2005 |
| JP | 2005-292356 | A | 10/2005 |

(Continued)

*Primary Examiner* — Sophia S Chen
(74) *Attorney, Agent, or Firm* — Banner & Witcoff, Ltd.

(57) ABSTRACT

An image forming apparatus has a drawer accommodating a plurality of photosensitive drums. The photosensitive drums are arranged in an arrangement direction. A supporting member is configured to support the drawer, inside the casing, such that the drawer is movable, in the arrangement direction, between an accommodated position and an exposed position at which the drawer is partially protruded outside the casing. A belt is arranged to convey the sheet, and has a stretched surface extending in the arrangement direction and facing the photosensitive drums. A registration roller pair serves to adjust an orientation of the sheet conveyed from the sheet feed tray and conveys the sheet through a nip between the first registration roller and the second registration roller toward the stretched surface of the belt. The registration roller pair is integrally secured to the drawer so as to be movable in the arrangement direction together with the drawer.

19 Claims, 12 Drawing Sheets

(56) References Cited

U.S. PATENT DOCUMENTS

| | | | | |
|---|---|---|---|---|
| 2005/0220482 | A1 | 10/2005 | Ishii | |
| 2005/0220494 | A1 | 10/2005 | Kato et al. | |
| 2005/0220517 | A1 | 10/2005 | Matsushima et al. | |
| 2005/0221907 | A1 | 10/2005 | Kato et al. | |
| 2006/0002735 | A1 | 1/2006 | Tamaru et al. | |
| 2006/0067734 | A1 | 3/2006 | Igarashi et al. | |
| 2006/0180973 | A1* | 8/2006 | Igarashi | G03G 21/1853 271/4.01 |
| 2007/0053716 | A1 | 3/2007 | Itabashi | |
| 2009/0060568 | A1 | 3/2009 | Ishikawa et al. | |
| 2009/0097894 | A1 | 4/2009 | Ito et al. | |
| 2010/0124432 | A1* | 5/2010 | Takayama | G03G 21/1853 399/110 |
| 2010/0329757 | A1 | 12/2010 | Souda | |
| 2012/0183325 | A1* | 7/2012 | Sato | G03G 21/1842 399/110 |

FOREIGN PATENT DOCUMENTS

| | | | |
|---|---|---|---|
| JP | 4161953 | B2 | 10/2008 |
| JP | 2009-058740 | A | 3/2009 |
| JP | 2011-013268 | A | 1/2011 |
| JP | 4692165 | B2 | 6/2011 |

* cited by examiner

IMAGE FORMING APPARATUS HAVING DRAWER

CROSS-REFERENCE TO RELATED APPLICATION

This application claims priority under 35 U.S.C. §119 from Japanese Patent Applications No. 2015-012580 filed on Jan. 26, 2015. The entire subject matter of the application is incorporated herein by reference.

BACKGROUND

Technical Field

The present disclosures relate to an image forming apparatus configured to form images on a printing sheet in accordance with an electrophotographic image forming method and provided with a drawer.

Related Art

There has been known an electrophotographic image forming apparatus which is configured such that multiple photosensitive drums are secured to a drawer which is attached to and can be drawn (i.e., slidably removed) from a main body (e.g., casing) of the image forming apparatus.

SUMMARY

According to the above-described conventional image forming apparatus, in order to prevent a situation where the photosensitive drums interfere with registration rollers when the drawer is drawn from the casing, a structure below is employed.

That is, when the drawer is fully accommodated in the casing (i.e., the drawer is in an accommodated position), each photosensitive drum contacts a belt which conveys a printing sheet. When the drawer is to be withdrawn from the accommodated position, the drawer is firstly moved upward to a position where each photosensitive drum does not interfere with the registration rollers.

In such a conventional image forming apparatus, it is necessary to employ a mechanism which lifts up the drawer to a position at which the photosensitive drums do not interfere with the registration rollers. Therefore, such a conventional image forming apparatus should employ a relatively complicated mechanism in order to allow drawing/inserting of the drawer.

In consideration of the above-described problem, aspects of the present disclosure provide an improved image forming apparatus in which a simple mechanism for the drawer.

According to aspects of the disclosures, there is provided an image forming apparatus configured to form an image on a sheet, which has a drawer accommodating a plurality of photosensitive drums each configured to bear developing agent, the photosensitive drums being parallel to each other in the drawer, the photosensitive drums being arranged in an arrangement direction which is a direction perpendicular to rotational axes of the photosensitive drums, a casing having a first opening, a supporting member configured to support the drawer such that the drawer is movable in the arrangement direction, the drawer being movable in the arrangement direction between an accommodated position at which the drawer is completely accommodated in the casing and an exposed position at which the drawer is protruded outside through the first opening such that the photosensitive drums are exposed to outside, a belt unit having a belt that moves to convey the sheet, the belt having a stretched surface extending in the arrangement direction and facing the photosensitive drums, a sheet feed tray arranged on a lower side with respect to the belt unit in a vertical direction, the sheet feed tray being capable of accommodating multiple sheets to be conveyed by the belt unit, a registration roller pair having a first registration roller and a second registration roller, the registration roller pair serving to adjust an orientation of the sheet conveyed from the sheet feed tray and conveys the sheet through a nip between the first registration roller and the second registration roller toward the stretched surface of the belt, the registration roller pair being integrally secured to the drawer so as to be movable in the arrangement direction together with the drawer, a contact part where the nip between the first registration roller and the second registration roller is formed is located on an upper side, in the vertical direction, with respect to the stretched surface of the belt, and a guiding part configured to guide the sheet discharged from the registration roller pair to the stretched surface of the belt such that the sheet is guided to the stretched surface of the belt at an acute angle.

According to aspects of the disclosures, there is also provided an image forming apparatus configured to form an image on a sheet, which has a casing having a first opening, a supporting member disposed in the casing and extending along a first direction, a belt unit having a belt, the belt having a stretched surface extending in the first direction, and a drawer. The drawer accommodates a plurality of photosensitive drums and a registration roller pair. The drawer is supported by the supporting member, and is movable in the first direction between, an accommodated position at which the drawer is completely accommodated in the casing, and an exposed position at which the drawer is protruded outside through the first opening and at least one of the photosensitive drums are exposed to outside. The registration roller pair has a first registration roller and a second registration roller. The registration roller pair is configured to feed the sheet through a nip between the first registration roller and the second registration roller toward the stretched surface of the belt; and the nip between the first registration roller and the second registration roller is located on an upper side, in the vertical direction, with respect to the stretched surface of the belt.

BRIEF DESCRIPTION OF ACCOMPANYING DRAWINGS

DETAILED DESCRIPTION OF ILLUSTRATIVE EMBODIMENTS

Hereinafter, illustrative embodiments according to aspects of the disclosures will be described. It is noted that the illustrative embodiments only shown illustrative examples according to aspects of the present disclosures and are not intended to restrict aspects of the disclosures.

The illustrative embodiments are configured such that aspects of the present disclosures are applied to a color image forming apparatus. Arrows indicating directions in each drawing are intended to assist comprehension of relationship among the drawings and not intended to limit precise orientation of the image forming apparatus.

Each of members and portions assigned with a reference number should be regarded such that at least one of such member or component is provided unless explicitly described that there are two or multiple of such members or parts.

First Illustrative Embodiment

1. General Description of Image Forming Apparatus

Figure 1:
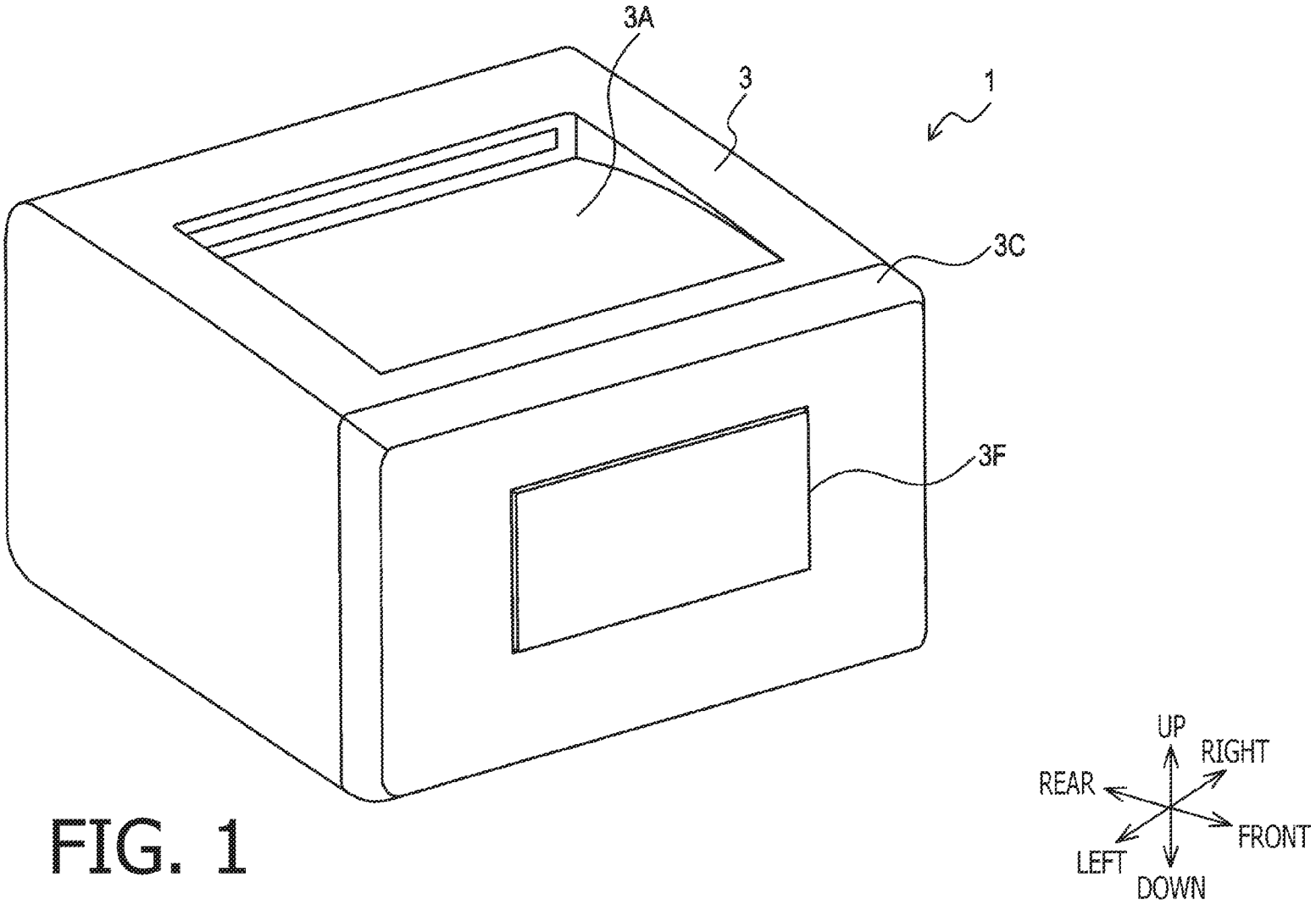
FIG. 1 is a perspective view of an image forming apparatus according to illustrative embodiments of the present disclosures.

In a casing 3 of an image forming apparatus 1 shown in FIG. 1, an image forming device 5 is accommodated. The image forming device 5 is configured to form images on sheets such as printing sheets in accordance with an electrophotographic image forming method. The image forming device 5 has at least one developing cartridge 7 and at least one photosensitive drum 8. Further, as in a conventional image forming device employing the electrophotographic image forming method, the image forming device 5 also includes at least one charger, at least one exposing device and at least one fixing device.

Figure 2:
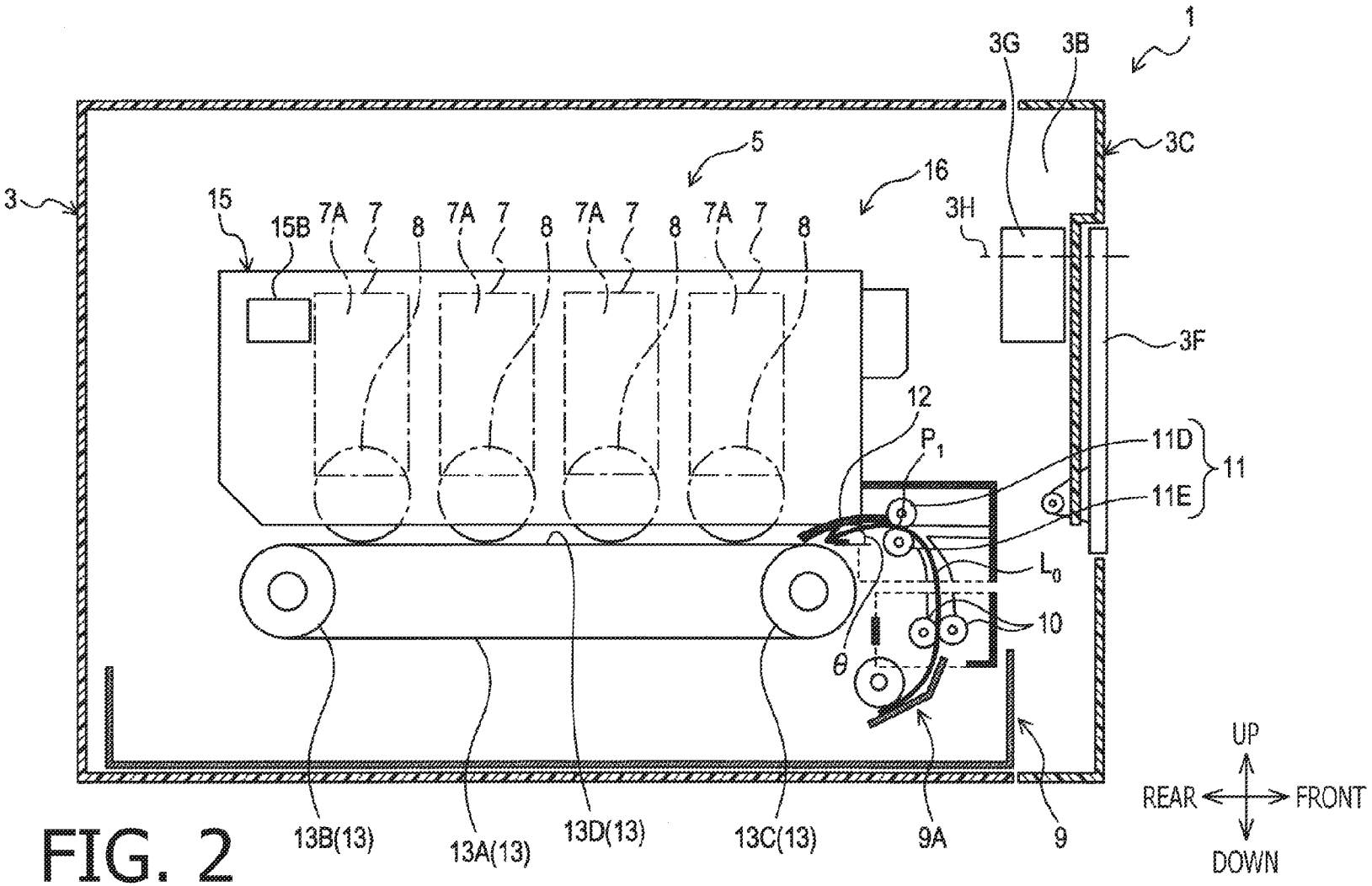
FIG. 2 is a cross-sectional side view of the image forming apparatus according to a first illustrative embodiment of the disclosures.

According to the illustrative embodiments described hereinafter, the image forming device 5 has multiple developing cartridges 7 as shown in FIG. 2. Further, each developing cartridge 7 includes a container 7A containing a developing agent. In the example shown in FIG. 2, there are four containers 7A provided to the four developing cartridges 7, respectively. The four container 7A contain developing agents of different colors (e.g., yellow, magenta, cyan and black), respectively.

Further, according to the illustrative embodiments, the number of photosensitive drums 8 and the number of chargers are the same as that of the developing cartridges 7 (i.e., four). The multiple photosensitive drums 8 are arranged in a direction perpendicular to rotation axes thereof (i.e., in front-rear direction of the image forming apparatus 1, which direction will also be referred to as an arrangement direction), the rotation axes of the multiple photosensitive drums 8 being parallel to each other.

It is noted that the rotation axes of the multiple photosensitive drums 8 are lines perpendicular to a plane of FIG. 2, or lines parallel to the right-left direction of the image forming apparatus 1.

As is conventionally known, the multiple chargers are respectively arranged to face the multiple photosensitive drums 8 to charge the same. Then, the exposing device is configured expose charged circumferential surfaces of the photosensitive drums 8, thereby forming electrostatic latent images thereon. As the developing agents are supplied onto the electrostatic latent images formed on the circumferential surfaces of the photosensitive drums 8, the developing agents corresponding to the electrostatic latent images are held on the circumferential surfaces of the multiple photosensitive drums 8, respectively.

A belt 13A is an endless belt wound around rollers 13B and 13C in a stretched state, and rotates in accordance with rotation of the rollers 13B and 13C. A stretched surface 13D of the belt 13A extends in a direction parallel to the arrangement direction and faces the multiple photosensitive drums 8.

As is employed in a conventional image forming device, the belt 13A, the rollers 13B and 13C are assembled to and supported by a pair of main frames and a belt unit frame which is a separate member. That is, the belt 13A and the rollers 13B and 13C integrally constitute a belt unit 13.

The belt unit 13 is detachably attached to the pair of main frames. Frame members of the pair of main frames are plate like strength members arranged on both sides in a direction of the rotational axes of the photosensitive drums 8, with sandwiching a drawer 15 and constitute, together with an exterior cover, at least a part of the casing 3. The exterior cover is a member constituting a design appearance of the image forming apparatus 1.

The sheet on which an image is to be formed is conveyed from a roller 13C side to a roller 13B side with being attracted by the stretch surface 13D of the belt 13A. At positions opposite to the photosensitive drums 8, transfer units are arranged, respectively, with the stretched surface 13D therebetween.

Each of the transfer units operates to transfer the developing agent carried by the corresponding photosensitive drum 8 onto the sheet. That is, the developing agents having different colors carried by respective photosensitive drums 8 are transferred on the sheet conveyed by the belt 13A in an overlaid manner.

The fixing device applies heat to the developing agents transferred onto the sheet with also applying pressure to permanently fix the developing agents on the sheet. The sheet on which the image (i.e., the developing agents) is thus formed is discharged and stacked on a discharge sheet tray 3A (see FIG. 1) formed on an upper surface of the casing 3.

On a lower side in the vertical direction with respect to the belt unit 13, a sheet feed tray 9 is arranged. The sheet feed tray 9 is configured such that multiple sheets to be conveyed toward the belt unit 13 can be placed thereon. The sheet feed tray 9 is detachably provided to the casing 3.

On an upstream side, in the sheet conveying direction, with respect to the belt 13A, a feeder mechanism 9A is provided. The feeder mechanism 9A is configured to feed the sheets placed on the sheet feed tray 9 one by one toward the image forming device 5.

A sheet conveying passage Lo extending from the feeder mechanism) 9A (sheet feed tray 9) to the stretched surface 13D is shaped to have a substantially U-shaped curvature. A sheet placed on the sheet feed tray 9 is firstly fed toward one end side in the arrangement direction (i.e., the front side, according to the illustrative embodiments). Then, the conveying direction of the sheet is changed to an upward direction in the vertical direction, and then the sheet is conveyed toward the other end side in the arrangement direction (i.e., the rear side, according to the illustrative embodiments).

Along the conveying passage Lo, a pair of conveying rollers 10, and a registration roller pair 11 including a first registration roller 11D and a second registration roller 11E are provided. The pair of conveying roller 10 is configured to sandwich the sheet fed from the feeder mechanism 9A and convey the sheet toward the registration pair 11.

The registration roller pair 11 is configured to correct attitude of the sheet sent from the sheet feed tray 9, then convey the sheet toward the stretched surface 13D. A contact part (hereinafter, also referred to as a nip part P1) at which the first registration roller 11D and the second registration roller 11E contact each other is arranged on an upper side in the vertical direction with respect to the stretched surface 13D in a state shown in FIG. 2.

It is noted that the nip part P1 is a linear or narrow strip-like part extending in a direction parallel to the rotational axis of the first registration roller 11D and the second registration roller 11E. It is also noted that the state shown in FIG. 2 is a state where the entire drawer 15 is accommodated in the casing 3. When the drawer 15 is located at a position shown in FIG. 2 (hereinafter, referred to as an accommodated position), each photosensitive drum 8 is located at a position where the developing agent can be transferred onto the sheet.

The registration roller pair 11 works as described below. When a leading end, in the conveying direction, of the sheet conveyed from the pair of conveying rollers 10 has reached the nip part P1, the first registration roller 11D and the second registration roller 11E are stopped (i.e., are not rotating).

Since the leading end of the sheet collides with the nip part P1, the attitude of the sheet is corrected such that the leading end of the sheet is aligned to extend along the nip part P1. Thereafter, rotations of the first registration roller 11D and the second registration roller 11E are re-started, thereby the sheet being conveyed toward the stretched surface 13D.

A conveying passage from the registration roller pair 11 to the stretched surface 13D is provided with a guide member 12. The guide member 12 is configured to guide the sheet sent out from the registration roller pair 11 toward the stretched surface 13D. The guide member 12 is configured to guide the sheet with an intrusion angle θ with respect to the stretched surface 13D being an acute angle. That is, the sheet is guided toward the stretched surface 13D at the acute angle.

That is, when the drawer 15 is located at the accommodated position, the nip part P1 is located on an upper side in the vertical direction with respect to the stretched surface 13D. The guide member 12 functions to direct the sheet discharged from the registration roller pair 11 to turn toward a lower side in the vertical direction, and to set the intrusion angle θ of the sheet with respect to the stretched surface 13D within a range of ten degrees or larger, and forty-five degrees or smaller.

2. Drawer Unit

The multiple developing cartridges 7, the multiple photosensitive drums 8 and multiple chargers are attached to the drawer 15. The multiple developing cartridges 7 are detachably attached to the drawer 15. In other words, the drawer 15 includes supporting structures that detachably support the multiple developing cartridges 7.

The photosensitive drums 8 and the chargers are not configured to be detachable with respect to the drawer 15 except when they are to be repaired. That is, in normal use, a user is allowed to detach the developing cartridges 7 from the drawer 15, but cannot detach the photosensitive drums 8 or the chargers from the drawer 15.

The drawer 15 has a box-like shape of which upper side is opened. The drawer 15 is attached to the pair of main frames via supporting members 17 such that the drawer 15 is movable with respect to the pair of main frames.

With the above-described configuration, the user can move the multiple developing cartridges 7, the multiple photosensitive drums 8 and the multiple chargers at the same time simply by moving the drawer 15. In this regard, a unit including the drawer 15 and components (e.g., the developing cartridges 7, the photosensitive drums 8 and the chargers) attached thereto as a drawer unit 16.

Figure 5:
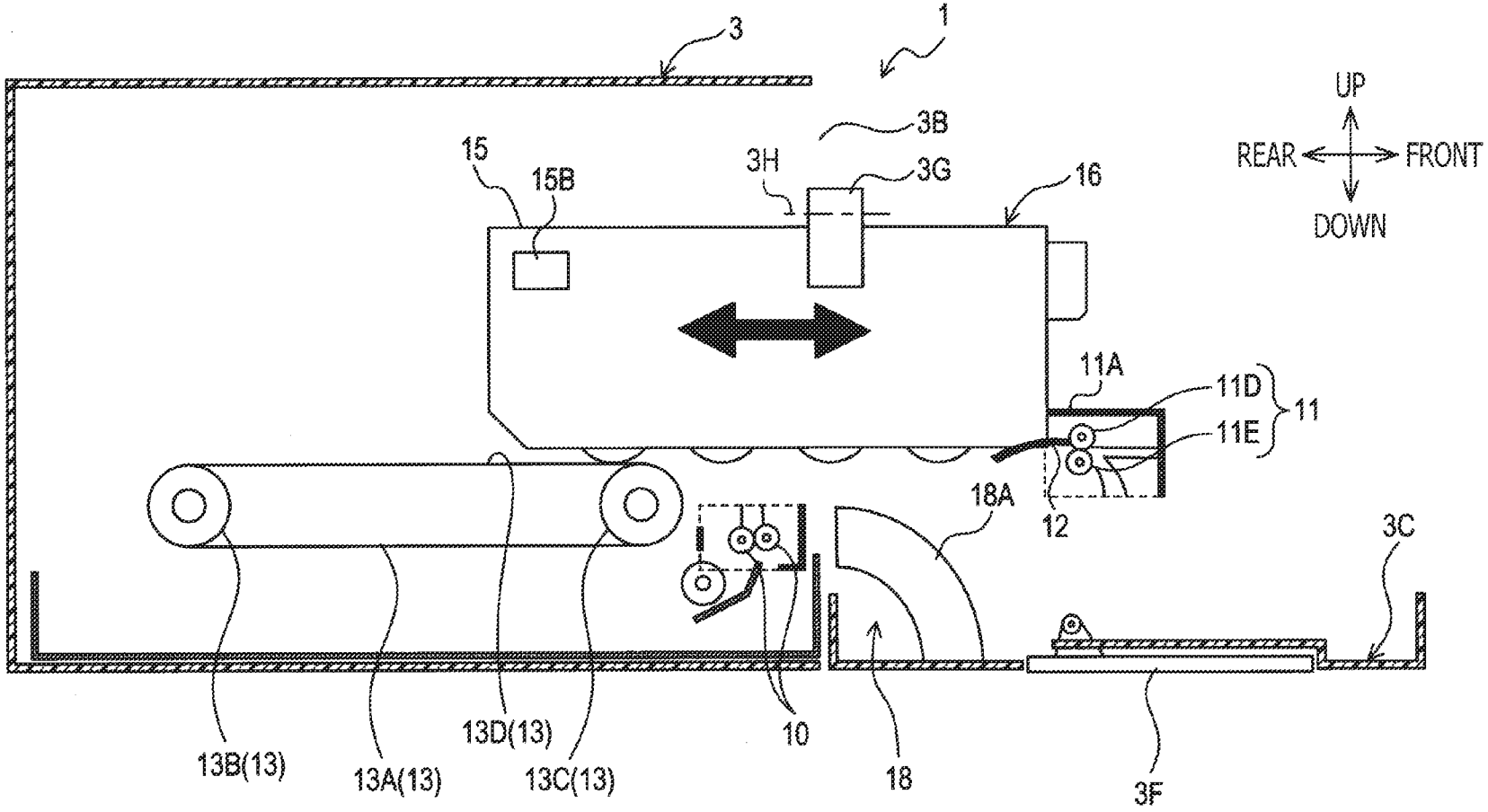
FIG. 5 is a cross-sectional side view of the image forming apparatus according to the first illustrative embodiment of the disclosures.
Figure 6:
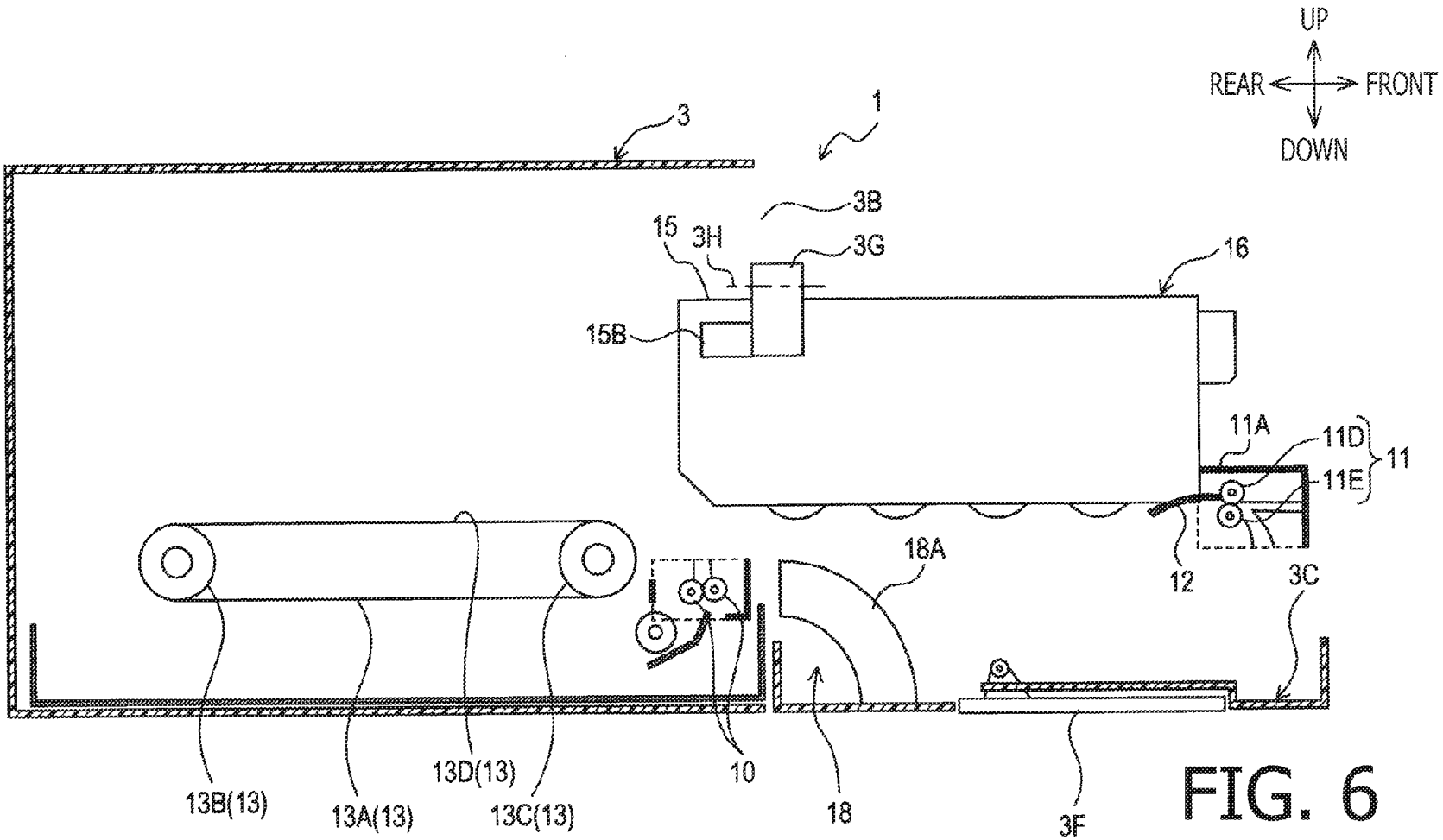
FIG. 6 is a cross-sectional side view of the image forming apparatus according to the first illustrative embodiment of the disclosures.
Figure 7:
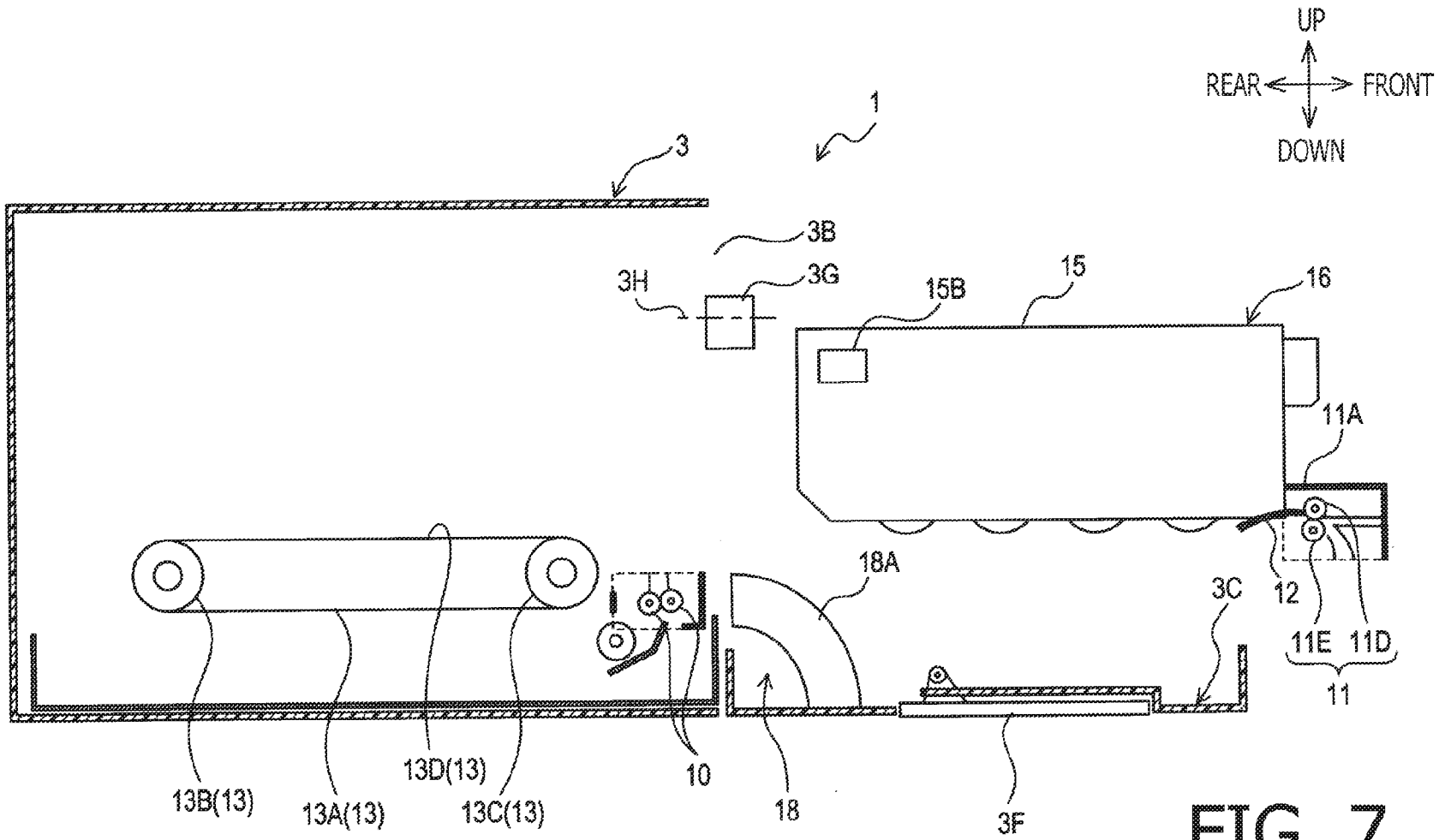
FIG. 7 is a cross-sectional side view of the image forming apparatus according to the first illustrative embodiment of the disclosures.

The supporting members 17 support the drawer 15 such that the drawer 15 can be moved in the arrangement direction. According to the illustrative embodiment, the supporting member 17 support the drawer 15 such that the drawer 15 can be moved between the accommodated position and an exposed position. It is noted that the exposed position is a position of the drawer 15 at which the multiple photosensitive drums 8 are exposed to outside through a first opening 3B as shown in FIGS. 5-7.

It is noted that, according to the illustrative embodiments, the supporting member 17 are rail-like members extending in the arrangement direction (i.e., front-rear direction), and provided to the main frame. Further, on each end, in the rotational axis direction, of the drawer, at least one engagement part 15A to be engaged with one of the supporting members 17 is provided. According to the illustrative embodiment, each engagement part 15A is a member configured to slidably contact or rotationally contact the rail-like supporting member 17.

A first opening 3B is an opening formed on the casing 3 at one end side, in the arrangement direction (on a front end side of the image forming apparatus 1, according to the illustrative embodiments).

Figure 3:
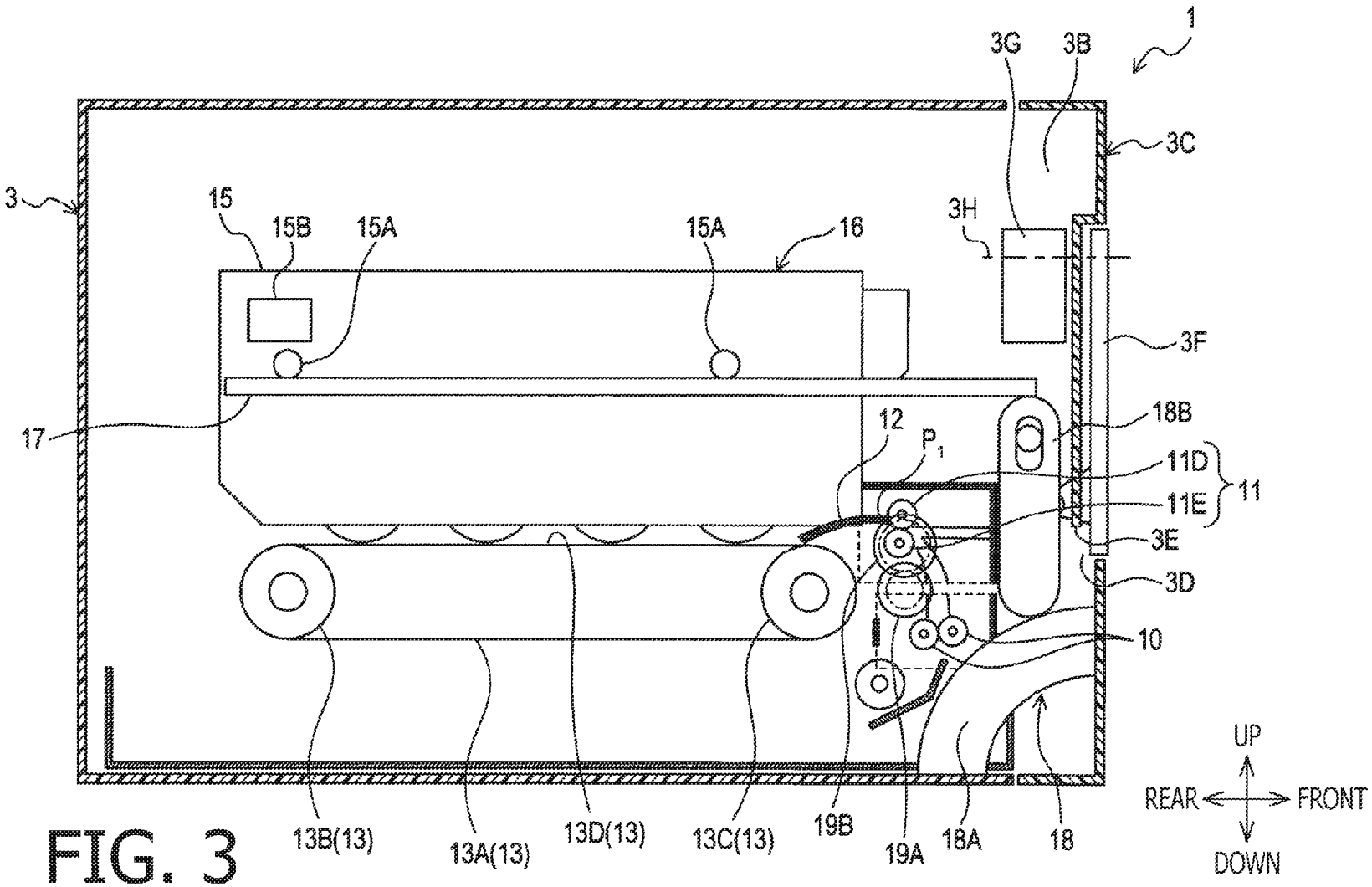
FIG. 3 is a cross-sectional side view of the image forming apparatus according to the first illustrative embodiment of the disclosures.
Figure 4:
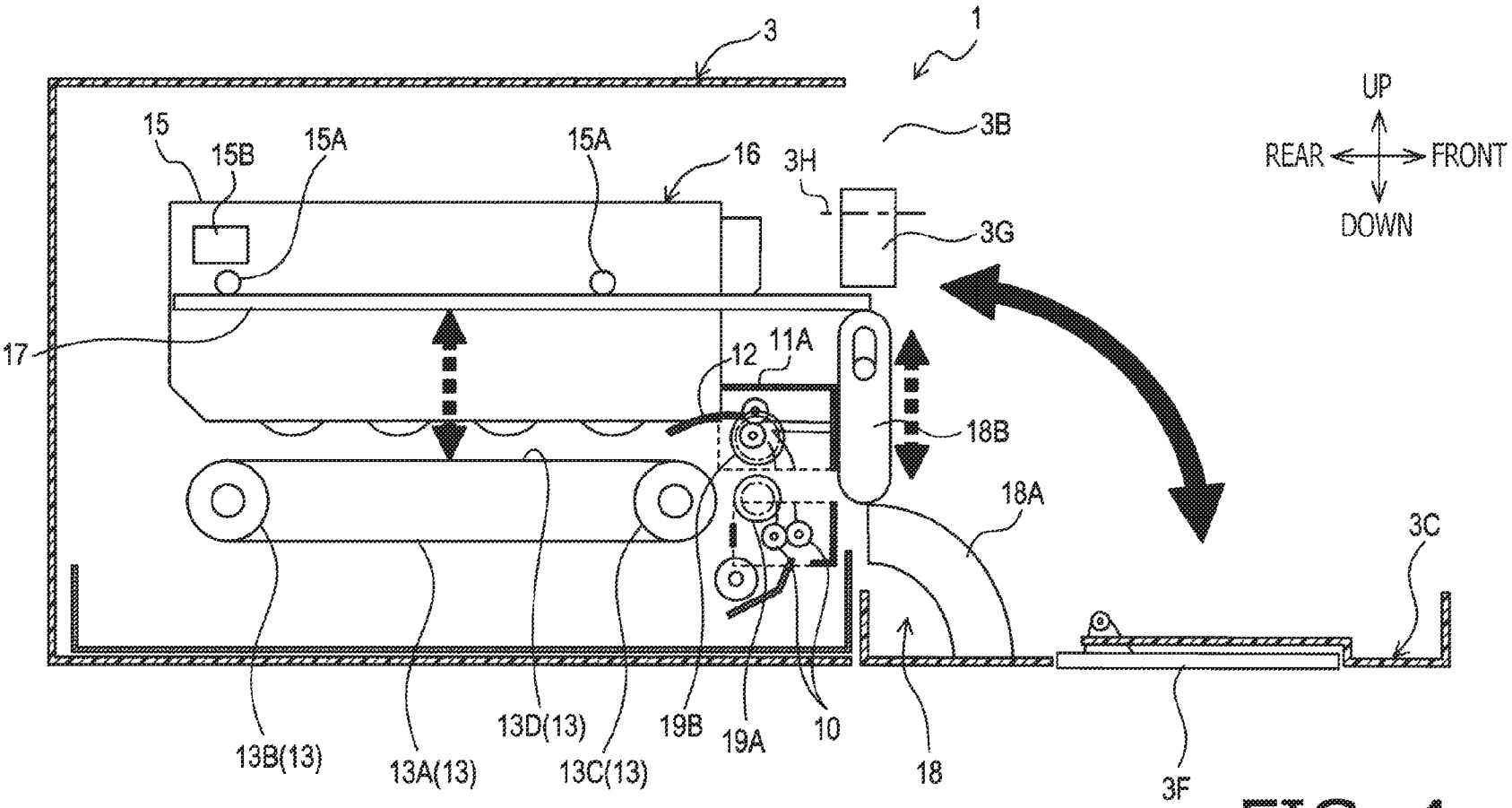
FIG. 4 is a cross-sectional side view of the image forming apparatus according to the first illustrative embodiment of the disclosures.

The first opening 3B is opened/closed by a front door 3C as shown in FIGS. 3 and 4. The front door 3C is configured to rotatably moves about a rotation axis which is defined at a lower part on the front side of the casing 3, and constitute a part of an appearance design of the casing 3.

On the front door 3C, a second opening 3D is formed as shown in FIG. 3. The second opening 3D is formed on the casing 3 at a position on an upper side, in the vertical direction, with respect to the stretched surface 13D. That is, at least an upper end 3E of the second opening 3D is located on an upper position, in the vertical direction, of the stretched surface 13D.

Figure 8A:
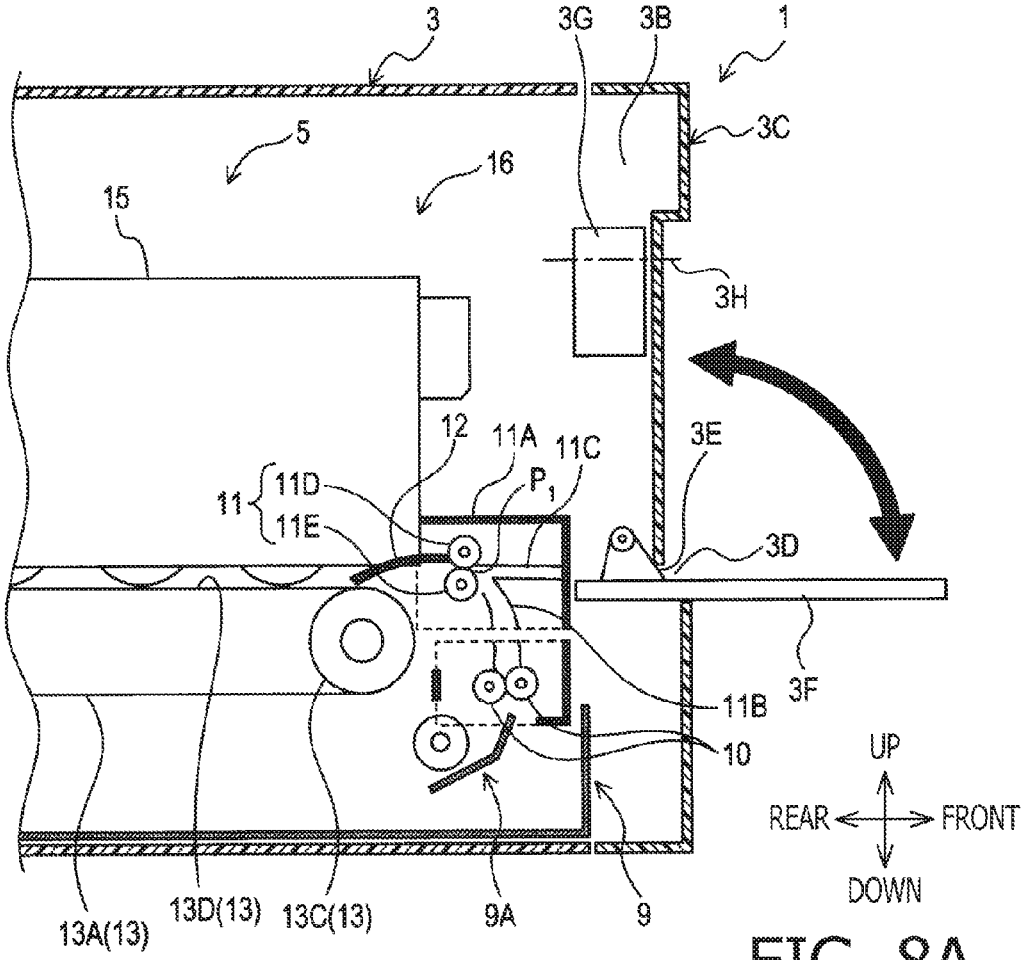
FIG. 8A is a cross-sectional partial side view of the image forming apparatus according to the first illustrative embodiment of the disclosures.

The second opening 3D is opened/closed by moving the front cover 3F. The front cover 3F is a tray-shaped member rotatably secured to the front door 3C. As shown in FIG. 8A, when the second opening 3D is exposed to outside, the front cover 3F serves as a sheet placement tray.

Figure 8B:
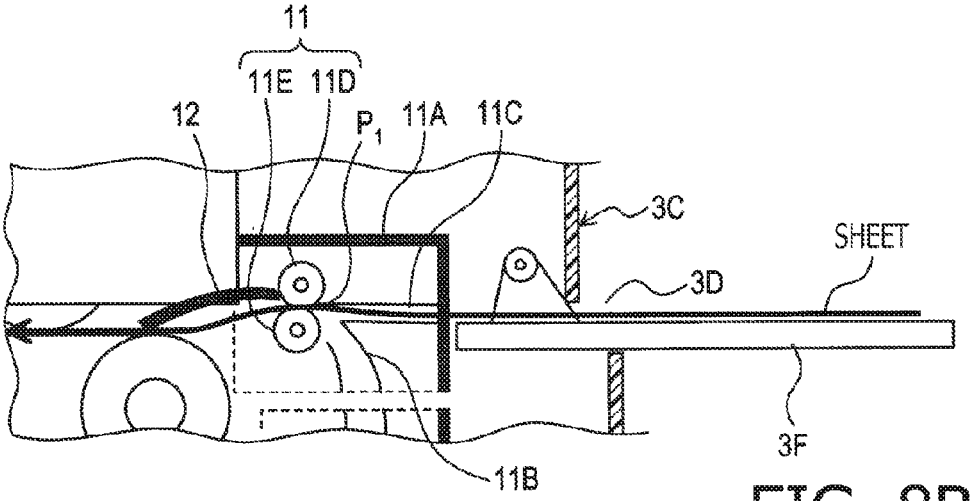
FIG. 8B is a cross-sectional partial side view around a manual insertion opening of the image forming apparatus according to the first illustrative embodiment of the disclosures.

Further, when the second opening 3D is opened, the second opening 3D communicate with the nip part P1 as shown in FIG. 8B, and a sheet can pass therethrough. That is, the second opening 3D serves as a manual supply opening or multipurpose sheet supply opening.

As shown in FIG. 8B, the registration roller pair 11 is integrally secured to the drawer 15 and is moved in the arrangement direction in association with the drawer 15. That is, on the first opening 3B side of the drawer 15, a holding member 11A which rotatably holds the first registration roller 11D and the second registration roller 11E is provide.

The holding member 11A is provided with a first guide part 11B configured to guide the sheet fed from the sheet feed tray 9 toward the nip part P1, and a second guide part 11C configured to guide the sheet inserted through the second opening 3D toward the nip part P1.

3. Lifting Mechanism

A lifting mechanism 18 enables the drawer 15 to be moved upward, in the vertical direction, to a position at which engagement between a driving gear 19A and a driven gear 19B is released as shown in FIG. 4.

The driven gear 19A is a gear provided to the casing 3 (i.e., to a main frame), and is driven to rotate by a driving force supplied by an electric motor (not shown). The driven gear 19B is a gear provided to the drawer 15.

The driven gear 19B is configured to engage with the driving gear 19A and transmit the driving force to at least one roller of the registration roller pair 11. According to the illustrative embodiments, the driving force is transmitted to the second registration roller 11E.

When the front door 3C is opened, the lifting mechanism 18 moves the drawer 15 upward, in the vertical direction, so that the engagement between the driving gear 19A and the driven gear 19B is released. Further, when the front door 3C is closed, the lifting mechanism 18 moves the drawer downward so that the driving gear 19A engages with the driven gear 19B.

The lifting mechanism 18 has a driving cam 18A and a driven cam 18B as shown in FIG. 4. The driving cam 18A is integrally formed to the front door 3C and is moved integrally with the front door 3C. According to the illustrative embodiments, the driving cam 18A has a cam surface on its outer circumferential surface which slidably contacts the driven cam 18B. the cam surface of the driving cam 18A is shaped such that, as the front door 3C is moved from a fully opened position to a closed position, the driving cam 18A moves the driven cam 18B upward in accordance with change of the position of the front door.

The driven cam 18B is configured to slidably contact the cam surface of the driving cam 18A and is moved vertically, and transmit the movement to the supporting member 17. According to the illustrative embodiments, the supporting member 17 extends in a front-rear direction, and is movable with respect to the main frame in accordance with the vertical movement of the driven cam 18B.

As shown in FIG. 4, when the front door 3C is opened, as the driven cam 18B is moved upward in the vertical direction, a driven gear 19B side end of the supporting member 17 is moved upward, in the vertical direction, by the driven cam 18B. As a result, the driving gear 19A and the driven gear 19B are disengaged.

When the front door 3C is closed as shown in FIG. 3, the driven cam 18B is moved downward by its own weight, and the driven gear 19B side end of the supporting member 17 is moved downward, in the vertical direction, by the own weight of the drawer unit 16. As a result, the driving gear 19A engages with the driven gear 19B.

4. Exchange of Developing Cartridge

As shown in FIG. 3, the main frames are provided with stoppers 3G configured to respectively contact contacting parts 15B provided on right and left sides of the drawer. Because of this structure, when a user draws out the drawer 15 from the casing 3, the contacting parts 15B respectively contact the stoppers 3G as shown in FIG. 6. Therefore, the drawer 15 does not protrude out of the casing 3 exceeding a particular amount. In other words, the stoppers 3G located at the contact position prevent the drawer 15 from falling out of the casing 3.

Each stopper 3G is configured to be movable between a contact position at which the stopper 3G contacts the contacting part 15B (see FIGS. 5 and 6) and a non-contact position which is a position shifted from the contact position at which the stopper 3G does not contact the contacting part 15B. Further, each stopper 3G is configured to rotate about an axis 3H located at an upper end portion thereof with respect to the corresponding frame. That is, each stopper 3G is rotatable about the axis 3H and movable between the contact position at which each stopper 3G contacts the contacting part 15B (see FIGS. 5 and 6) and the non-contact position at which none of the stoppers 3G contact the contacting parts 15B (see FIG. 7).

When the drawer 15 is located at the exposed position (see FIGS. 5, 6 and 7), the user can exchange the developing cartridges attached to the drawer 15. Further, when the entire drawer 15 is to be exchanged, the user may draw the entire drawer 15 from the casing with the stopper 3G being located at the non-contact positions (see FIG. 7).

5. Characteristic Features

According to the illustrative embodiment described above, the registration roller pair 11 is integrally secured to the drawer 15, and is moved together with the drawer 15. Therefore, according to the illustrative embodiment, a problem that "each photosensitive drum 8 interferes with the registration roller pair" does not occur structurally.

Accordingly, it is not necessary to have a mechanism to move the drawer 15 on an upper side, in the vertical direction, so that the each photosensitive drum 8 does not interfere with the registration roller pair. Thus, with a relatively simple structure, the image forming apparatus in which the drawer 15 can be drawn from the casing of the image forming apparatus can be configured.

It is noted that the lifting mechanism according to the illustrative embodiment is a mechanism to release the engagement between the driving gear 18A and the driven gear 19B, and does not correspond to the above mentioned movement mechanism to move the drawer 15. That is, it is sufficient that the lifting mechanism 18 according to the illustrative embodiment can lift the drawer 15 by a total tooth height of the driving gear 19A and the driven gear 19B.

According to the illustrative embodiment, since the registration roller pair 11 is integrally provided to the drawer 15, parallelism among the photosensitive drums 8 and the registration roller pair 11 can be improved relatively easily.

Incidentally, if the registration roller pair 11 is secured to the casing 3, since the drawer 15 is movable with respect to the casing, it is difficult to improve the parallelism between the photosensitive rollers 8 and the registration roller pair 11.

According to the illustrative embodiment, the second opening 3D is formed at an upper part of the casing, in the vertical direction, with respect to the stretched surface 13D, and the second opening 3D communicates with the nip part P1 and allows the sheet to pass therethrough.

With this structure, it is possible to suppress the sheet conveying passage from the second opening 3D to the registration roller pair 11 from curving largely. Therefore, even through a relatively thick sheet is supplied through the second opening 3D, such a sheet can be conveyed well.

Second Illustrative Embodiment

Figure 9A:
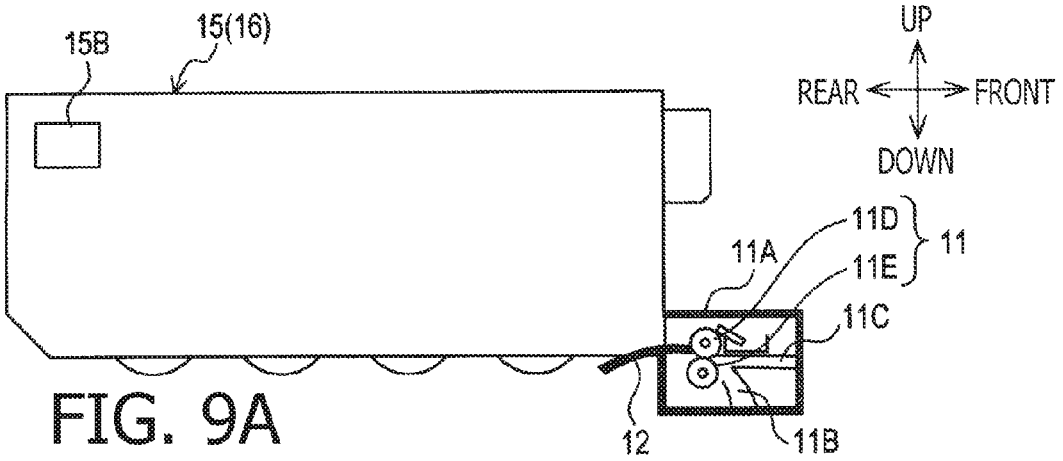
FIGS. 9A-9C illustrate how an image forming apparatus according to a second illustrative embodiment of the disclosures works.
Figure 9B:
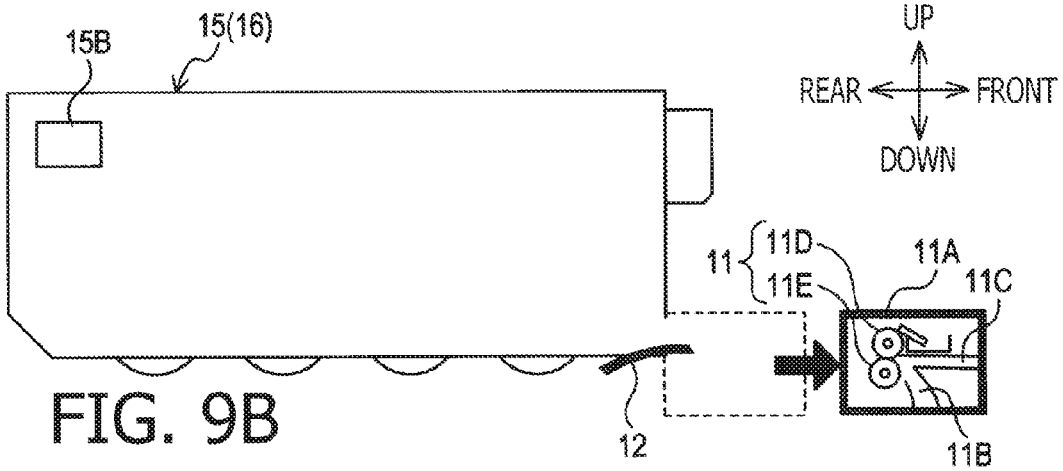
Figure 9C:
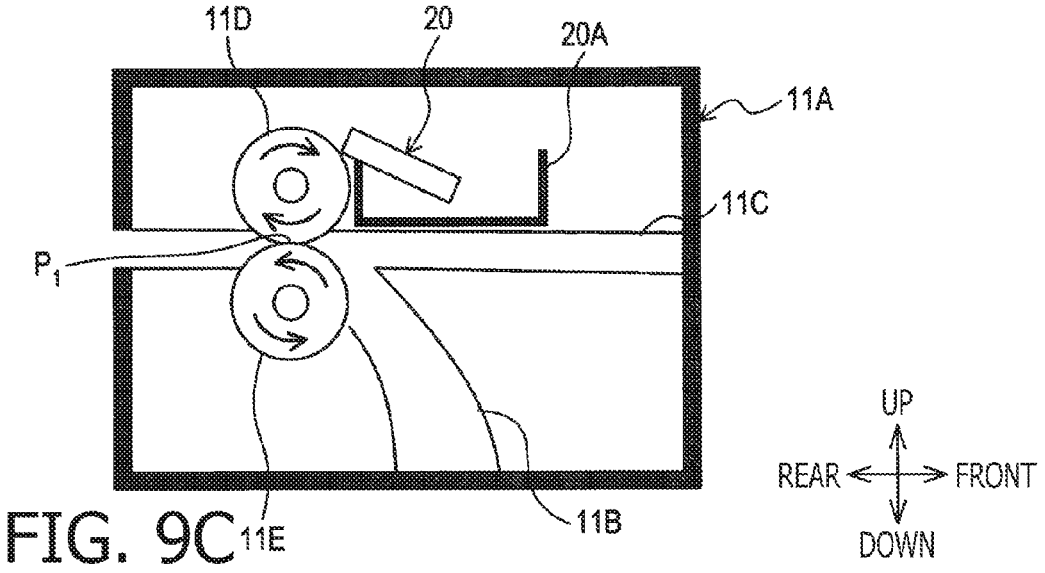

According to the second illustrative embodiment, the holding member 11A is detachably attached to the drawer as shown in FIGS. 9A and 9B. Further, the holding member 11A has a removing mechanism 20 and a container 20A as shown in FIG. 9C.

The removing mechanism 20 is for removing adhered substances such as paper particles and the like which are adhered on the sheet. According to the second illustrative embodiment, the removing mechanism 20 has a blade (e.g., a scraper). The blade is configured to slidably contact one of the registration roller pair 11, specifically, the first registration roller 11D which is the roller contacting a surface of the sheet on which the developing agent is applied.

The removing mechanism 20 (i.e., the scraper) contacts the first registration roller 11D and scrapes off adhered substances which are electrostatically adhered from the sheet onto the first registration roller 11D. The scraped substances are contained in the container 20A.

With the above configuration, the user can eliminate the substances accumulated in the container 20A simply by detaching the holding member 11A from the drawer 15.

Third Illustrative Embodiment

Figure 10:
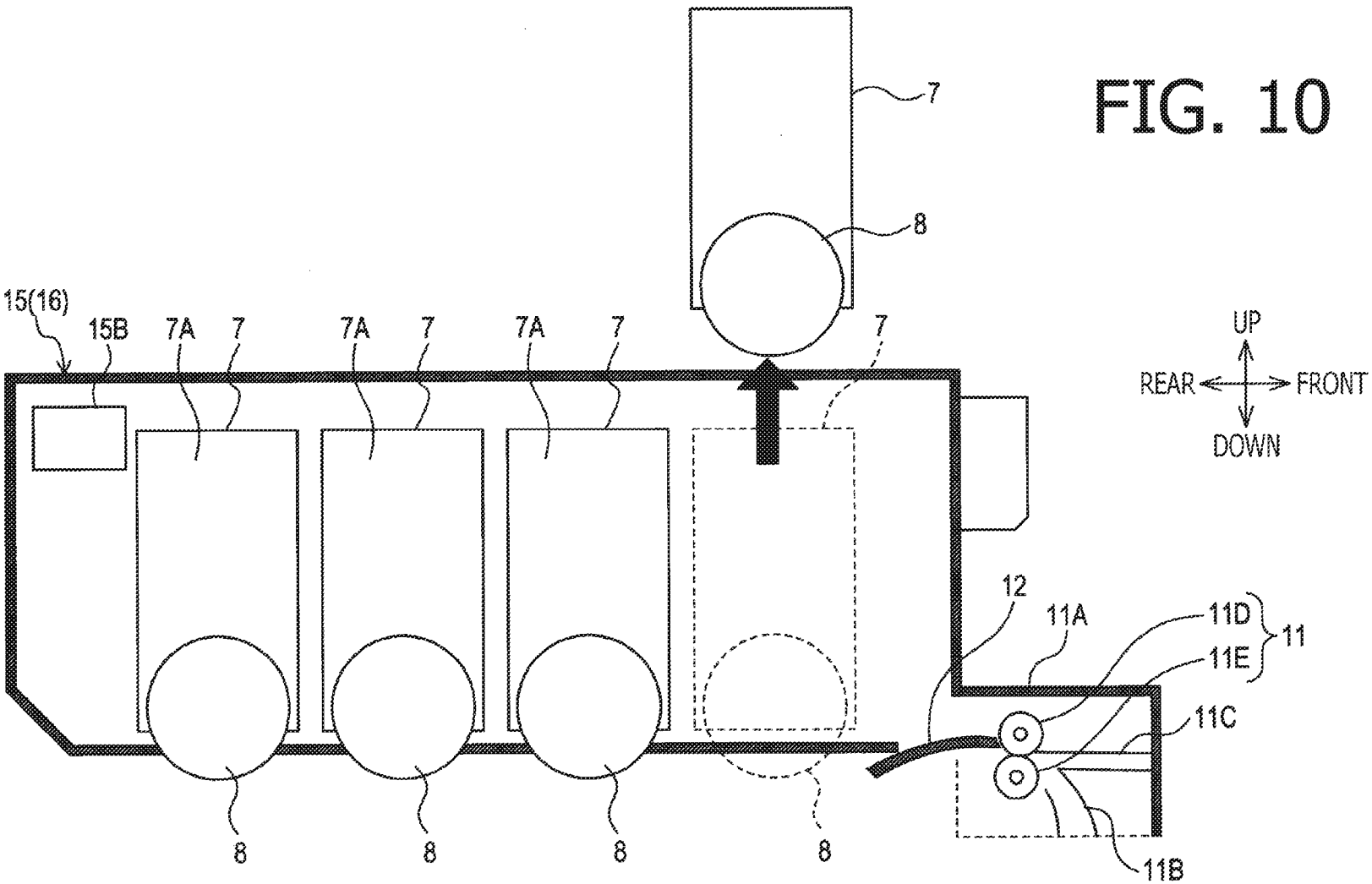
FIG. 10 is a cross-sectional side view illustrating how an image forming apparatus according to a third illustrative embodiment work.

According to a third embodiment, as shown in FIG. 10, the multiple photosensitive drums 8 are detachably attached to the drawer 15.

It is noted that, in an example shown in FIG. 10, each of the multiple photosensitive drums 8 is coupled to a developing cartridge 7 so as not to be detachable. Further, each developing cartridge 7 is detachably secured to the drawer 15. With this configuration, the multiple photosensitive drums 8 are indirectly detachable with respect to the drawer 15.

It is noted that the structure needs not be limited to one shown in FIG. 10, and various modifications can be made. For example, each of the photosensitive drums 8 may be directly and detachably attached to the drawer 15.

Fourth Illustrative Embodiment

Figure 11:
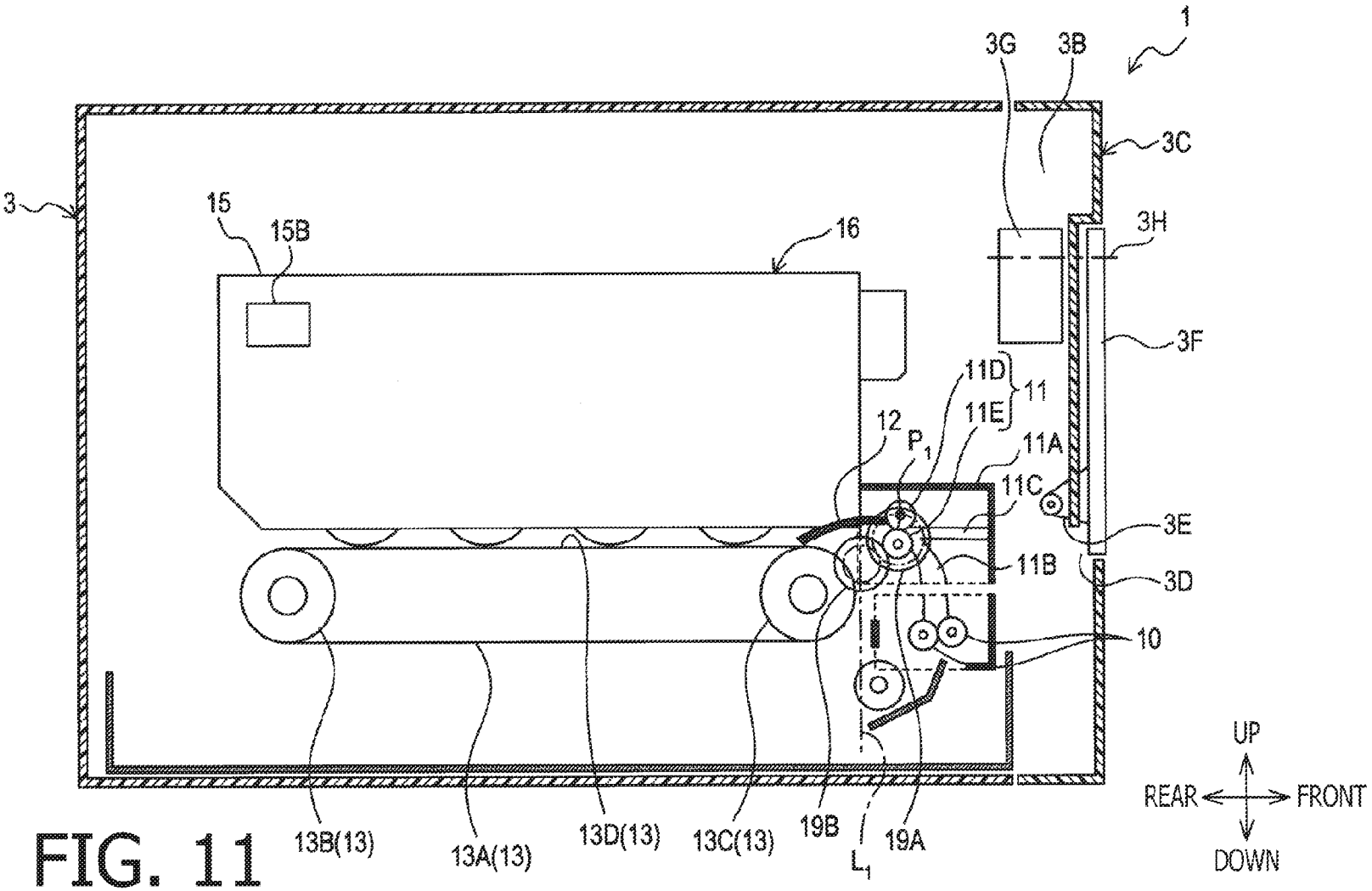
FIG. 11 is a cross-sectional side view illustrating how an image forming apparatus according to a fourth illustrative embodiment work.
Figure 12:
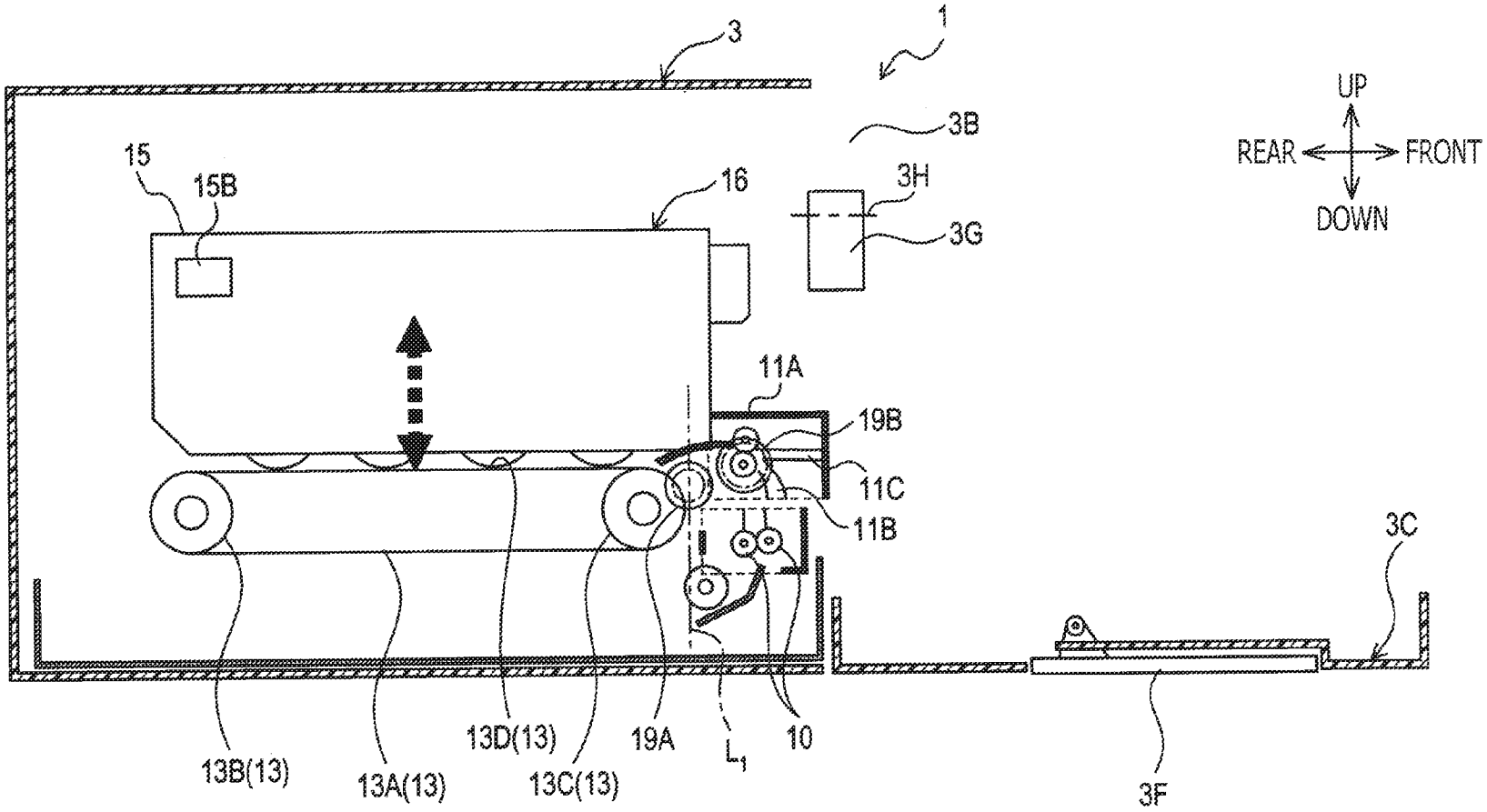
FIG. 12 is a cross-sectional side view illustrating how the image forming apparatus according to the fourth illustrative embodiment work.

According to a fourth illustrative embodiment, as shown in FIGS. 11 and 12, the lifting mechanism is omitted. That is, according to the first through third illustrative embodiments, a center of rotation of the driven gear 19B is located on a virtual vertical line passing a center of rotation of the driving gear 19A. Because of this configuration, in order to disengage the driving gear 19A and the driven gear 19B, it is necessary to move the drawer 15 upward in the vertical direction.

In contrast, according to the fourth illustrative embodiment, the center of rotation of the driven gear 19B is shifted on the first opening 3B side with respect to the virtual vertical line L1 as shown in FIG. 11. Therefore, simply by moving the drawer 15 on the first opening 3B side, the engagement between the driven gear 19B and the driving gear 19A can be released.

Further, when the driven gear 19B is disengaged from the driving gear 19A as shown in FIG. 12, simply by moving the drawer 15 toward inside of the casing 3, the driven gear 19B is engaged with the driving gear 19A.

Since the lifting mechanism 18 can be omitted according to the fourth embodiment, the image forming apparatus having a drawer can be configured with simple structure.

Other Embodiments

In the above-described illustrative embodiments, the second opening 3D is formed on the casing 3. It is noted that the aspects of the disclosures need not be limited to such a structure, and the second opening 3D may be omitted.

The lifting mechanism 18 according to the first through third illustrative embodiments is configured to work in association with open/close movement of the front cover 3D. The aspects of the disclosures need not be limited to such a structure, and an operating member such as a lever may be provided to the casing to operate the lifting mechanism 18.

It is also noted that aspects of the disclosures need not be limited to the above-described embodiments, and various modifications can be realized within scopes of the claims.

What is claimed is:

1. An image forming apparatus configured to form an image on a sheet, comprising:

a drawer accommodating a plurality of photosensitive drums each configured to store developing agent, the photosensitive drums being parallel to each other when disposed in the drawer, the photosensitive drums being arranged in an arrangement direction perpendicular to rotational axes of the photosensitive drums;

a casing having a first opening;

a driving gear provided to the casing;

a supporting member configured to support the drawer such that the drawer is movable in the arrangement direction, the drawer being movable in the arrangement direction between an accommodated position at which the drawer is entirely accommodated in the casing and an exposed position at which the drawer extends outside through the first opening such that the photosensitive drums are exposed to an outside of the image forming apparatus;

a belt unit having a belt that moves to convey the sheet, the belt having a stretched surface extending in the arrangement direction and facing the photosensitive drums;

a sheet feed tray arranged on a lower side with respect to the belt unit in a vertical direction, the sheet feed tray being capable of accommodating multiple sheets to be conveyed by the belt unit;

a registration roller pair having a first registration roller and a second registration roller, the registration roller pair configured to adjust an orientation of the sheet conveyed from the sheet feed tray and to convey the sheet through a nip between the first registration roller and the second registration roller toward the stretched surface of the belt, the registration roller pair being integrally secured to the drawer so as to be movable in the arrangement direction together with the drawer, a contact part where the nip between the first registration roller and the second registration roller is formed is located on an upper side, in the vertical direction, with respect to the stretched surface of the belt;

a driven gear provided to the drawer, the driven gear being configured to engage with the driving gear to receive a driving force from the driving gear and transmit the driving force to the first registration roller;

a lifting mechanism configured to lift the drawer upward, in the vertical direction, until the driven gear is disengaged from the driving gear; and a guiding part configured to guide the sheet discharged from the registration roller pair to the stretched surface of the belt such that the sheet is guided to the stretched surface of the belt at an acute angle.

2. The image forming apparatus according to claim 1, wherein a second opening is formed on the casing at a position upward, in the vertical direction, with respect to the stretched surface of the belt, the second opening communicating with the contact part and allowing the sheet to pass through.

3. The image forming apparatus according to claim 1, further comprising a door configured to close and open the first opening, wherein the lift mechanism is configured to move the drawer upward, in the vertical direction so that the driven gear is disengaged from the driving gear, when the door is opened, and to move the drawer downward, in the vertical direction, when the door is closed.

4. The image forming apparatus according to claim 1, further comprising a holding member detachably attached to the drawer, the holding member accommodating the registration roller pair.

5. The image forming apparatus according to claim 4, further comprising:

a removing mechanism configured to remove adhered substances adhered on the sheet; and a container provided to the holding member, the container being configured to contain the adhered substances removed by the removing mechanism.

6. The image forming apparatus according to claim 1, wherein the photosensitive drums are assembled to the drawer so as not to be detached from the drawer.

7. The image forming apparatus according to claim 1, wherein the photosensitive drums are detachably attached to the drawer.

8. The image forming apparatus according to claim 1, further comprising multiple cartridges respectively holding the photosensitive drums, wherein the multiple cartridges are detachably attached to the drawer.

9. An image forming apparatus configured to form an image on a sheet, comprising:

a casing having a first opening;

a drawer;

a driving gear provided to the casing;

a supporting member disposed in the casing and extending along a first direction;

a belt unit having a belt, the belt having a stretched surface extending in the first direction;

a driven gear provided to the drawer; and a lifting mechanism configured to lift the drawer upward, in a vertical direction, until the driven gear is disengaged from the driving gear, the drawer comprising:

a plurality of photosensitive drums; and a registration roller pair, wherein:

the drawer is supported by the supporting member; and the drawer is movable in the first direction between:

an accommodated position at which the drawer is completely accommodated in the casing, and an exposed position at which the drawer is protruded outside through the first opening and at least one of the photosensitive drums is exposed to the outside, and wherein:

the registration roller pair comprises:

a first registration roller; and a second registration roller, the registration roller pair is configured to feed the sheet through a nip between the first registration roller and the second registration roller toward the stretched surface of the belt, the nip between the first registration roller and the second registration roller is located on an upper side, in the vertical direction, with respect to the stretched surface of the belt, and the driven gear is configured to engage with the driving gear to receive a driving force from the driving gear and transmit the driving force to the first registration roller.

10. The image forming apparatus according to claim 9, further comprising a holding member detachably attached to the drawer, the holding member accommodating the registration roller pair.

11. The image forming apparatus according to claim 10, further comprising:

a removing mechanism configured to remove adhered substances adhered on the sheet; and a container provided to the holding member, the container being configured to contain the adhered substances removed by the removing mechanism.

12. The image forming apparatus according to claim 9, wherein the photosensitive drums are assembled to the drawer so as not to be detached from the drawer.

13. The image forming apparatus according to claim 9, wherein the photosensitive drums are detachably attached to the drawer.

14. The image forming apparatus according to claim 9, further comprising multiple cartridges respectively holding the photosensitive drums, wherein the multiple cartridges are detachably attached to the drawer.

15. An image forming apparatus configured to form an image on a sheet, comprising:

a drawer accommodating a plurality of photosensitive drums each configured to store developing agent, the photosensitive drums being parallel to each other when disposed in the drawer, the photosensitive drums being arranged in an arrangement direction perpendicular to rotational axes of the photosensitive drums;

a casing having a first opening;

a supporting member configured to support the drawer such that the drawer is movable in the arrangement direction, the drawer being movable in the arrangement direction between an accommodated position at which the drawer is entirely accommodated in the casing and an exposed position at which the drawer extends outside through the first opening such that the photosensitive drums are exposed to an outside of the image forming apparatus;

a belt unit having a belt that moves to convey the sheet, the belt having a stretched surface extending in the arrangement direction and facing the photosensitive drums;

a sheet feed tray arranged on a lower side with respect to the belt unit in a vertical direction, the sheet feed tray being capable of accommodating multiple sheets to be conveyed by the belt unit;

a registration roller pair having a first registration roller and a second registration roller, the registration roller pair configured to adjust an orientation of the sheet conveyed from the sheet feed tray and to convey the sheet through a nip between the first registration roller and the second registration roller toward the stretched surface of the belt, the registration roller pair being integrally secured to the drawer so as to be movable in the arrangement direction together with the drawer, a contact part where the nip between the first registration roller and the second registration roller is formed is located on an upper side, in the vertical direction, with respect to the stretched surface of the belt;

a guiding part configured to guide the sheet discharged from the registration roller pair to the stretched surface of the belt such that the sheet is guided to the stretched surface of the belt at an acute angle; and a holding member detachably attached to the drawer, the holding member accommodating the registration roller pair.

16. The image forming apparatus according to claim 15, further comprising:

a removing mechanism configured to remove adhered substances adhered on the sheet; and a container provided to the holding member, the container being configured to contain the adhered substances removed by the removing mechanism.

17. The image forming apparatus according to claim 15, wherein the photosensitive drums are assembled to the drawer so as not to be detached from the drawer.

18. The image forming apparatus according to claim 15, wherein the photosensitive drums are detachably attached to the drawer.

19. The image forming apparatus according to claim 15, further comprising multiple cartridges respectively holding the photosensitive drums, wherein the multiple cartridges are detachably attached to the drawer.

* * * * *